US008276418B2

(12) United States Patent
Martin

(10) Patent No.: US 8,276,418 B2
(45) Date of Patent: Oct. 2, 2012

(54) SECURITY COVER PLATE WITH ACCENTRIC MOUNTING APERTURE

(75) Inventor: Frank J. Martin, Edmonds, WA (US)

(73) Assignee: Olympus Lock, Inc., Lynnwood, WA (US)

( * ) Notice: Subject to any disclaimer, the term of this patent is extended or adjusted under 35 U.S.C. 154(b) by 1149 days.

(21) Appl. No.: 12/001,999

(22) Filed: Dec. 12, 2007

(65) Prior Publication Data

US 2008/0156054 A1 Jul. 3, 2008

Related U.S. Application Data

(63) Continuation of application No. 10/754,170, filed on Jan. 9, 2004, now abandoned.

(51) Int. Cl.
*A47B 95/04* (2006.01)

(52) U.S. Cl. ..... 70/452; 70/370; 70/449

(58) Field of Classification Search ..... 70/78, 85, 70/370–374, 381, 447–452
See application file for complete search history.

(56) References Cited

U.S. PATENT DOCUMENTS

| | | | | |
|---|---|---|---|---|
| 1,377,457 | A | 5/1921 | Block | |
| 1,500,297 | A | 7/1924 | Best | |
| 1,832,108 | A | 11/1931 | Falk | |
| 2,039,244 | A | 4/1936 | Lowe | 70/46 |
| 2,307,106 | A | 1/1943 | Brush | 70/447 |
| 2,430,391 | A | 11/1947 | Dequick | 70/368 |
| 2,720,103 | A | 10/1955 | Golden et al. | 70/86 |
| 2,807,158 | A | 9/1957 | Best | 70/370 |
| 3,263,461 | A | 8/1966 | Tartaglia | 70/383 |
| 3,276,232 | A | 10/1966 | Bourgeois | |
| 3,399,555 | A | 9/1968 | Gray et al. | 70/369 |
| 3,589,152 | A | 6/1971 | Glass et al. | 70/81 |
| 3,774,423 | A | 11/1973 | Orr | 70/375 |
| 3,824,817 | A | 7/1974 | Orr | 70/81 |
| 3,899,907 | A | 8/1975 | Prahl | |
| 4,012,928 | A | 3/1977 | Dauenbaugh | 70/81 |

(Continued)

FOREIGN PATENT DOCUMENTS

JP 52-45500 9/1977

OTHER PUBLICATIONS

Olympus Lock, Inc., Product Catalog, "*Patented Commercial Pin Tumbler & IC Core Cabinet Locks; Olympus 2000 Integrated Cabinet Pull & Lock; Solid Brass Padlocks ShurLok Lock Box*", Oct. 2001, p. 34.

(Continued)

*Primary Examiner* — Christopher Boswell
(74) *Attorney, Agent, or Firm* — Lowe Graham Jones PLLC

(57) ABSTRACT

A cover plate assembly 10 is provided for a cabinet door or drawer lock 12. A cover plate 26 defines a first circular aperture 28 and a rotatably circular cover plate insert 32 defines an eccentrically positioned second circular aperture 34. The second circular aperture 34 defines an inner diameter 33 sized to selectively receive the cylinder and plug assembly housing 20, and the insert 32 has an outer diameter 39 sized to fit within and selectively rotate with respect to the first circular aperture 28. During installation, the outer diameter 39 of the insert 32 is positioned within the first circular aperture 28, and the insert 32 is selectively rotated to a position that enables the cover plate assembly 10 to register with a bolt housing 16 and the second circular aperture 34 to register with a cylinder and plug assembly housing 20.

5 Claims, 4 Drawing Sheets

U.S. PATENT DOCUMENTS

| | | | | |
|---|---|---|---|---|
| 4,099,397 | A | 7/1978 | Dauenbaugh | 70/371 |
| 4,338,806 | A | 7/1982 | Cox | |
| 4,471,638 | A | 9/1984 | Scheerhorn | 70/368 |
| 4,630,457 | A | 12/1986 | Kincaid et al. | 70/369 |
| 4,633,690 | A | 1/1987 | Foshée | 70/451 |
| 4,899,563 | A | 2/1990 | Martin | 70/367 |
| 4,920,774 | A | 5/1990 | Martin | 70/367 |
| 5,038,589 | A | 8/1991 | Martin | 70/368 |
| 5,121,619 | A | 6/1992 | Martin | 70/371 |
| 5,216,910 | A | 6/1993 | Lin | |
| 5,657,652 | A | 8/1997 | Martin | 70/85 |
| 5,737,950 | A | 4/1998 | Yun-Bin | 70/379 R |
| 5,884,512 | A | 3/1999 | Wayne | |
| 5,907,963 | A | 6/1999 | Myers et al. | |
| 6,295,850 | B1 | 10/2001 | Anderson | |
| 6,412,317 | B1 | 7/2002 | Martin | 70/81 |
| D469,329 | S | 1/2003 | Martin | D8/301 |
| 6,523,379 | B2 | 2/2003 | Teskey | |

OTHER PUBLICATIONS

National Cabinet Lock, Catalog Supplement, 1988, 1 page.
National Cabinet Lock, Catalog Supplement, "*New Stock Locks Items*", 1 page **(Published more than 1 year prior to the filing date).
Exploded View & Parts List, Brochure, 1 page **(Published more than 1 year prior to the filing date).

SECURITY COVER PLATE WITH ACCENTRIC MOUNTING APERTURE

CROSS REFERENCE TO RELATED APPLICATIONS

This application is a continuation of U.S. patent application Ser. No. 10/754,170, filed Jan. 9, 2004 now abandoned title "SECURITY COVER PLATE WITH ACCENTRIC MOUNTING APERTURE", and claims the benefit of the filing date of said prior co-pending application.

BACKGROUND OF THE INVENTION

1. Field of the Invention

The invention relates generally to locks for cabinet doors or drawers. More specifically, the invention relates to apparatus and methods for cover plates that can be used on a cabinet door or drawer lock having different installation positions.

2. Description of the Related Art

A wide variety of cabinet door and drawer locks are currently available in this well developed art. U.S. Pat. No. 4,920,774 to Martin entitled "Self-Aligning Re-Keyable Pin Tumbler Cabinet Door Lock" issued May 1, 1990, and assigned to the assignee of the present invention illustrates one example of an typical cabinet door and drawer lock. Such locks may have a substantially rectangular bolt housing in which resides a retractable dead bolt or latch bolt. See U.S. Pat. No. 5,657,652 to Martin. A cylinder and plug assembly conventionally resides in a cylindrical cylinder and plug assembly housing which itself extends forwardly from the bolt housing. The bolt housing is typically mounted to the back side of a cabinet door or drawer, while the cylinder and plug assembly housing protrudes through a circular aperture in the cabinet door or drawer. The bolt is retracted or extended by inserting a key into the cylinder and plug assembly and rotating the key. A strike plate may be provided on an opposing cabinet door or adjacent drawer jamb in the case of a cabinet drawer.

A cover plate may be used in conjunction with the bolt housing to retain the lock against the back side of the cabinet door or drawer and to provide an aesthetically pleasing, flush appearance for the front of the cylinder and plug assembly with respect to the outside of the cabinet door or drawer. The cover plate is positioned on the front side of a cabinet door or drawer, placed in registration with the bolt housing and the cylinder and plug assembly housing, and usually affixed to the bolt housing with screws or the like. By being in registration with the cylinder and plug assembly housing, the cover plate covers the surface area adjacent to the circular aperture in the cabinet door or drawer that receives the cylinder and plug assembly housing. This makes the lock more robust and helps deter thieves from prying apart the lock. By covering the surface area of the cabinet door or drawer adjacent to the cylinder and plug assembly housing, the cover plate also protects the exterior surface of the drawer or cabinet from accidental scratches that could occur should a user cause the key to accidentally slip in an attempt to insert the key within the cylinder and plug assembly. To provide strength and resist key scratches, the cover plate is conventionally made of hardened metal and, to meet aesthetic needs, can be designed in a variety of shapes and sizes. A cover plate of the type described has been offered for sale by the assignee of the invention disclosed herein since 2001 under the model designation "ETS-1."

Other cabinet door or drawer locks have a dead bolt or latch that can be selectively set to a number of positions to accommodate different types of installment configurations. One example is disclosed in U.S. Pat. No. 5,737,950 to Martin entitled "Ambidextrous Vertical Inverted Handed Cam Lock" issued on Apr. 14, 1998, also assigned to the assignee of the present invention. In that patented design, a rotatable cam operates a latch. The cam is journaled for rotation with the plug and can be repositioned to accommodate different types of installations. Such locks are advantageous as they can be used to secure a desk drawer with the latch optionally facing upwardly or downwardly, or to secure a cabinet drawer with the latch facing optionally towards the left or the right. Nevertheless, in every configuration the spring loaded pins of the cylinder and plug assembly are advantageously maintained in a vertical orientation.

The cam type lock disclosed in the Martin '950 patent has an exposed bolt and cam mechanism which is easily repositioned without removing the lock body (essentially an externally threaded cylinder and plug assembly) from the cabinet door or drawer application. Cabinet and door locks of the type shown in the Martin '774 patent have separate bolt and cylinder and plug assembly housings. The relative positions of these housings can be different depending on the intended orientation (e.g., right hand, left hand, bolt up, bolt down) of the bolt. Thus, in order for the cover plate to be registrable with both the bolt housing and the cylinder and plug assembly housing, a different cover plate configuration is typically required for each type of installation.

As a result, when a single model lock has a number of different installment orientations, and the relative positioning of the cylinder and plug assembly with respect to the bolt housing also differs depending on the installment orientation, there is a need for a single model cover plate that is registrable with the cabinet door or drawer lock regardless of the position in which the lock is installed.

BRIEF SUMMARY OF THE INVENTION

It is therefore an object of the present invention to provide a single model cover plate assembly that can be registered with a multi-positionable cabinet door or drawer lock regardless of the position in which the lock is installed.

It is a further object of the invention to achieve the above object by placing the cover plate assembly in concurrent registration with a cylinder and plug assembly housing and a bolt housing.

These objects, and other objects and advantages of the invention, which will become apparent from the description which follows, are achieved by providing a cover plate assembly for registration with a cabinet door or drawer lock having a bolt housing that selectively rotates with respect to a portion of a cylinder and plug assembly housing. The cover plate assembly has a cover plate defining a first circular aperture and a rotatably circular cover plate insert defining an eccentrically positioned second circular aperture. The second circular aperture defines an inner diameter sized to selectively receive the cylinder and plug assembly housing, and the insert has an outer diameter sized to fit within and selectively rotate with respect to the first circular aperture.

When installing the cover plate assembly for registration with the cabinet door or drawer lock, the outer diameter of the insert is positioned within the first circular aperture, and the insert is selectively rotated to a position that enables the cover plate assembly to register with the bolt housing and the second circular aperture to register with the cylinder and plug assembly housing.

BRIEF DESCRIPTION OF THE SEVERAL VIEWS OF THE DRAWING

In the drawings, the sizes and relative positions of elements are not necessarily drawn to scale. For example, the shapes of various elements and angles are not drawn to scale, and some of these elements are arbitrarily enlarged to improve drawing legibility.

DETAILED DESCRIPTION OF THE INVENTION

Figure 1:
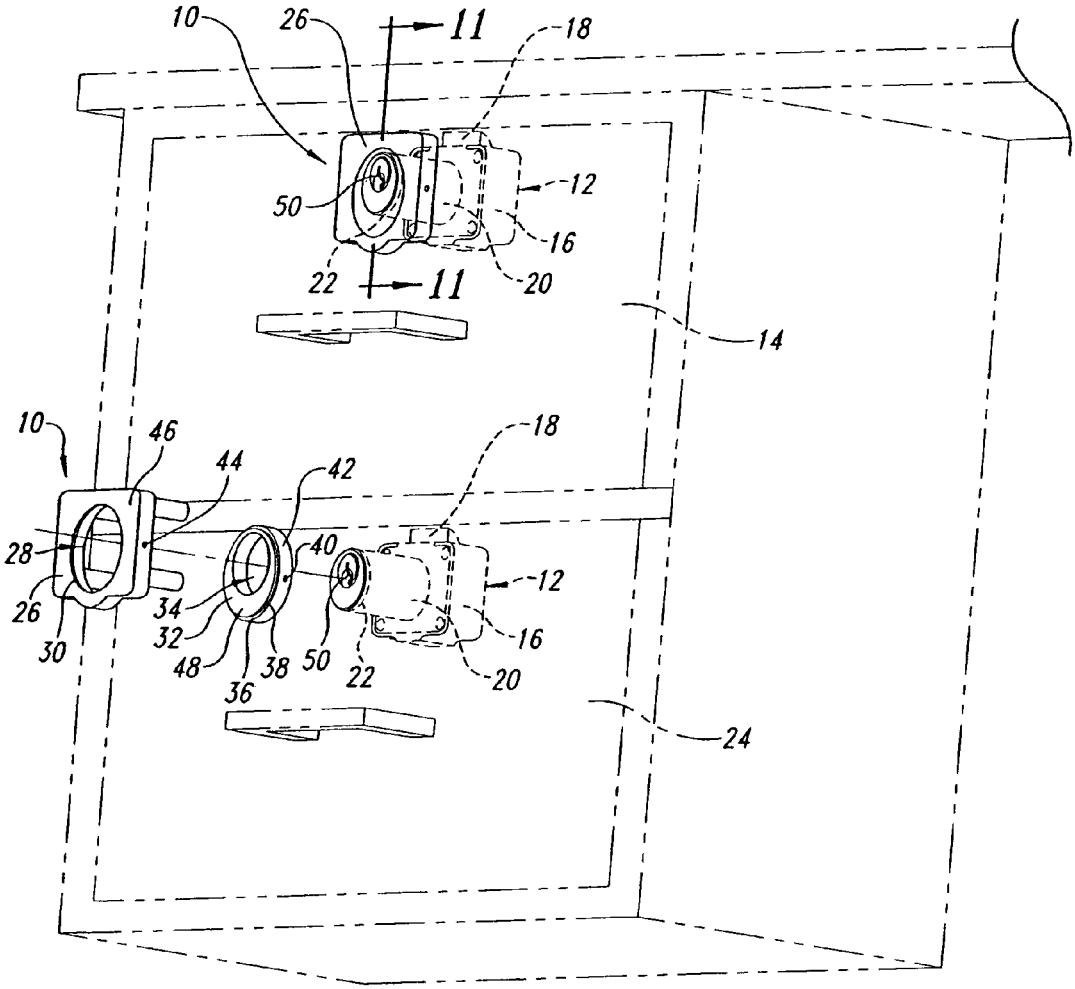
FIG. 1 is a perspective environmental view of a cover plate assembly for a cabinet door or drawer lock. A top drawer shows the cover plate assembly in registration with a bolt housing and a cylinder and plug assembly housing. A bottom drawer shows the cover plate assembly in an exploded view.

A preferred embodiment of a cover plate assembly, in accordance with the principles of the invention, is generally indicated at reference numeral 10 in the Figures. As described in further detail below, the cover plate assembly 10 is uniquely configured to register with a type of cabinet door or drawer lock 12 that can be optionally installed in a number of different positions.

FIG. 1 shows the cabinet door or drawer lock 12, generally indicated at reference numeral 12 and shown in phantom lines, mounted to a top desk drawer 14. The lock has a substantially rectangular bolt housing 16 in which resides a retractable latch bolt 18, and a cylindrical cylinder and plug assembly housing 20. The cylinder and plug assembly housing 20 extends forwardly from the bolt housing 16. When the lock 12 is in an installed position, the cylinder and plug assembly housing 20 protrudes through a circular aperture 22 in the drawer 14.

The top desk drawer 14 shows the cover plate assembly 10 in its mounted position. The assembly 10 is in registration with the bolt housing 16 and the cylinder and plug assembly housing 20. A bottom desk drawer 24 shows an exploded view of the cover plate assembly 10. The cover plate assembly 10 has a cover plate 26 defining a first circular aperture generally indicated at reference numeral 28 with a peripheral, circumferential stop 30. The cover plate assembly 10 further has a rotatably mounted, circular cover plate insert 32 having an inner diameter 33 defining an eccentrically positioned second circular aperture 34 and an outer circumference 36 defining a circumferential retaining ridge 38. A four detents 40, spaced at 90° intervals, reside on an outer diameter 42 of the insert 32, and a threaded hole 44 adapted for receipt of a conventional set screw (not shown) resides on a side of the cover plate 26. The cover plate 26 and the insert 32 have substantially the same thickness, and is preferably made of a scratch-resistant metal.

The bottom desk drawer 24 shows how the components of the cover plate assembly 10 are assembled. The outer diameter 42 of the insert 32 is positioned within the first circular aperture 28. As the cover plate 26 and the insert 32 have substantially the same thickness, when the insert 32 is inserted within the first circular aperture 28, an outer surface 46 of the cover plate 26 is substantially flush with an outer surface 48 of the insert 32. To limit the forward axial movement of the insert 32 with respect to the cover plate 26, the retaining ridge 38 of the insert 32 is in cooperative engagement with the stop 30. The insert 32 can selectively rotate within the cover plate 26 because the cover plate assembly 10 is registrable with the cabinet door or drawer lock 12 regardless of the installed lock 12 position. This allows a lock smith or person installing the lock 12 to rotate the insert 32 within the cover plate 26 and, as explained further below, orientate the insert 32 to a position that allows the cover plate assembly 10 to be in concurrent registration with both the bolt housing 16 and the cylinder and plug assembly housing 20, regardless of the position in which retractable latch bolt 18 faces.

Figure 2:
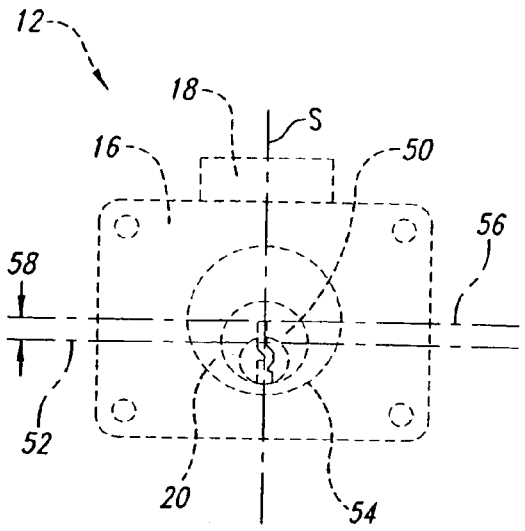
FIG. 2 is a front elevational view of a bolt housing and a cylinder and plug assembly housing, with the bolt housing in a first position with respect to the cylinder and plug assembly housing.
Figure 3:
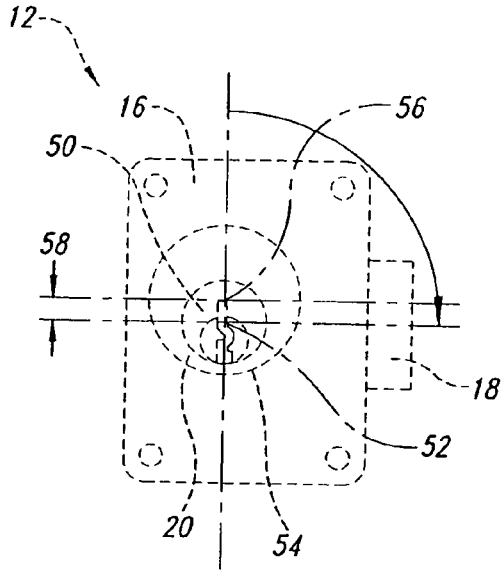
FIG. 3 is a front elevational view of the bolt housing and the cylinder and plug assembly housing shown in FIG. 2, with the bolt housing in a second position with respect to the cylinder and plug assembly housing.
Figure 4:
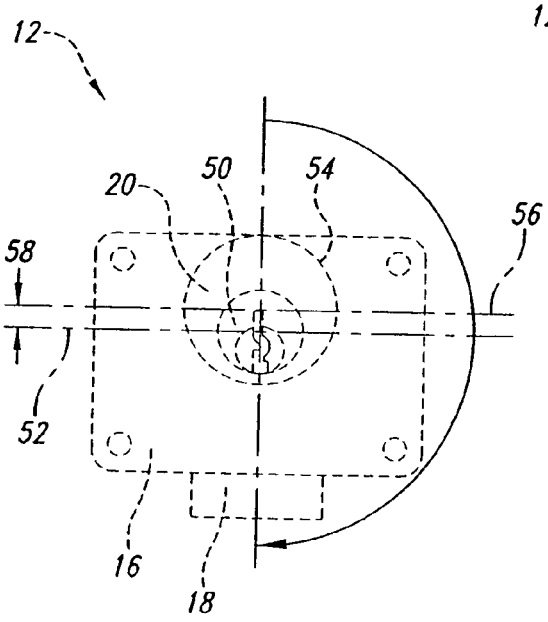
FIG. 4 is a front elevational view of the bolt housing and the cylinder and plug assembly housing shown in FIG. 2, with the bolt housing in a third position with respect to the cylinder and plug assembly housing.
Figure 5:
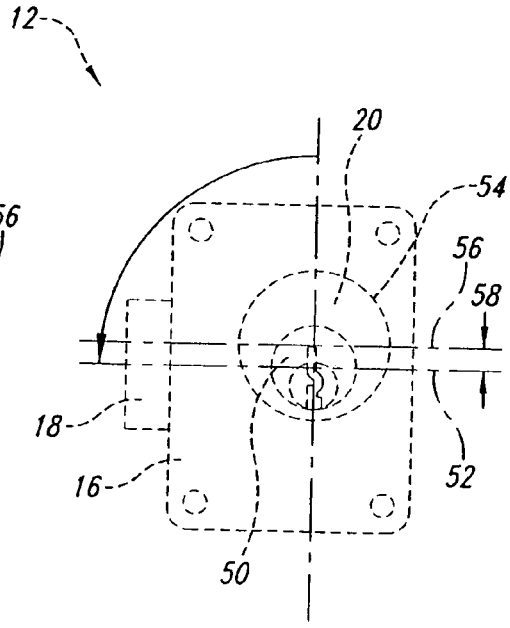
FIG. 5 is a front elevational view of the bolt housing and the cylinder and plug assembly housing shown in FIG. 2, with the bolt housing in a fourth position with respect to the cylinder and plug assembly housing.
Figure 6:
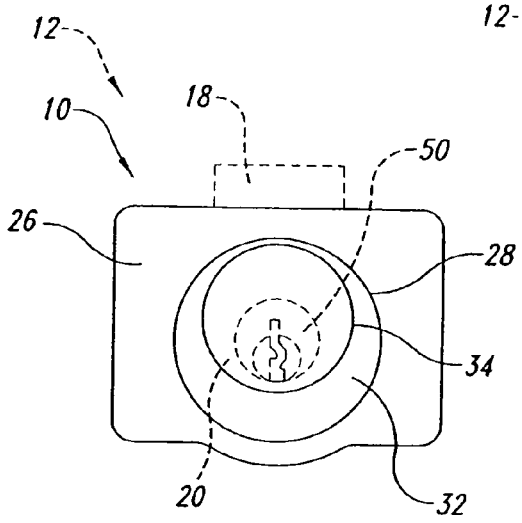
FIG. 6 is front elevational view of the cover plate assembly shown in FIG. 1, with the cover plate assembly in a first position and in registration with the bolt housing and the cylinder and plug assembly housing shown in FIG. 2.
Figure 7:
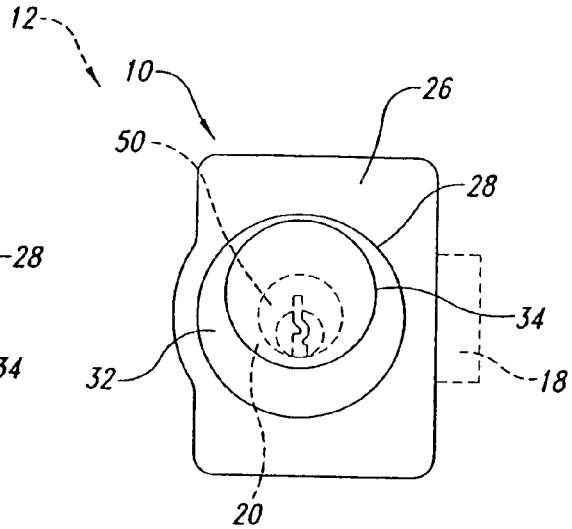
FIG. 7 is a front elevational view of the cover plate assembly shown in FIG. 1, with the cover plate assembly in a second position and in registration with the bolt housing and the cylinder and plug assembly housing shown in FIG. 3.
Figure 8:
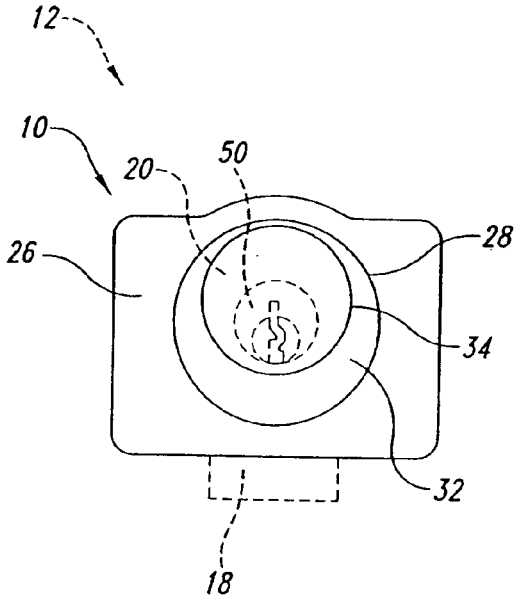
FIG. 8 is a front elevational view of the cover plate assembly shown in FIG. 1, with the cover plate assembly in a third position and in registration with the bolt housing and the cylinder and plug assembly housing shown in FIG. 4.
Figure 9:
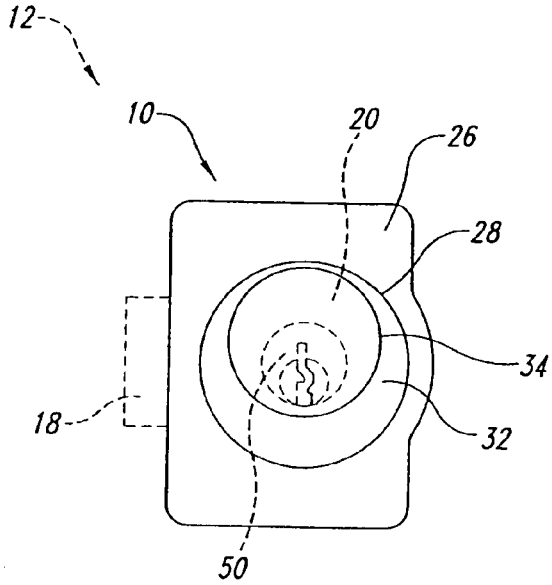
FIG. 9 is a front elevational view of the cover plate assembly shown in FIG. 1, with the cover plate assembly in a fourth position and in registration with the bolt housing and the cylinder and plug assembly housing shown in FIG. 5.

In one embodiment, FIGS. 2-5 show that the cabinet door or drawer lock 12 has up to four different mounting positions. This is because the bolt housing 16 is rotatable with respect to a plug portion 50 of the cylinder and plug assembly housing 20 so as to maintain spring loaded pins (not shown) which are internal to the cylinder and plug assembly in a preferred, vertical rest position. FIG. 2 shows the bolt housing 16 in a first (bolt up), or start, position. The retractable latch bolt 18 faces upwardly, and this provides the user with the option of mounting the lock 12 to a cabinet drawer 14, 24, as exemplified in FIG. 1. FIG. 3 shows the bolt housing 16 rotated 90° clockwise (bolt right) with respect to the cylinder and plug assembly housing 20 and from the start position shown in FIG. 2. This provides the user with the option of mounting the lock 12 to a left side of a double-sided cabinet door. FIG. 4 shows the bolt housing 16 rotated 180° clockwise (bolt down) with respect to the cylinder and plug assembly housing 20 and from the start position shown in FIG. 2. This provides the user with the option of mounting the lock 12 to a right side of a double-sided cabinet door. FIG. 5 shows the bolt housing 16 rotated 90° counterclockwise (bolt left) with respect to the cylinder and plug assembly housing 20 and from the start position shown in FIG. 2. This provides a user with the option of mounting the lock 12 in an inverted position to secure a cabinet door having a downward swinging door, such as the type commonly found in showcase and display case applications.

The bolt housing 16 rotates with respect to a plug portion 50 within the cylinder and plug assembly housing 20 because the position of a center plug axis 52 through the plug portion 50 within the cylinder and plug assembly housing 20 remains at a fixed position with respect to the bolt housing 16. However, as the bolt housing 16 is rotated from the start position shown in FIG. 2 to any one of the positions shown in FIGS. 3-5, the location of an outer perimeter 54 of the cylindrical cylinder an plug assembly housing 20 changes with respect to the bolt housing 16. Thus, the location of a center housing axis 56 through the cylinder and plug assembly housing 20 also changes with respect to the bolt housing 16. But, as FIGS. 2-5 show, regardless of the bolt housing 16 position, a distance 58 between the location of the center plug axis 52 through the plug portion 42 and the location of the center housing axis 56 through the entire cylinder and plug assembly housing 20 remains the same. The above-described structure allows the bolt housing 16 (and thus the latch bolt 18) to be rotatably positionable with respect to the cylinder and plug assembly 20 without the necessity of repositioning a cam driving member (not shown) which is internal to the bolt housing 16. In this respect, the structure described above differs from the invention disclosed in the applicant's U.S. Pat. No. 5,737,950 in which the cam mechanism is external to the lock and thus easily repositioned while the lock is still mounted to the cabinet door or drawer.

FIGS. 6-9 show the cover plate assembly 10 in registration with the cabinet door or drawer lock 12, according to the rotated orientation of the bolt housing 16 shown in FIGS. 2-5, respectively. To place the cover plate assembly 10 in registration with both the bolt housing 16 and the cylinder and plug assembly housing 20, the first circular aperture 28 is centered about the center plug axis 52 and the second circular aperture 34 is centered about the center housing axis 56 of the cylinder and plug assembly housing 20. While the orientation of the cover plate 26 needed to center the first circular aperture 28 about the center housing axis 56 of the cylinder and plug assembly housing 20 may be determined with the insert 32 already positioned within in the first circular aperture, it will likely be easier to determine the center of the first circular aperture 28 prior to inserting the insert 32.

Once the orientation of the cover plate 26 is determined, the outer diameter 42 of the insert 32 can be inserted within the first circular aperture 28 and selectively rotated until the center of the second circular aperture 34 is about the center housing axis 56 of the cylinder and plug assembly housing 20. Centering the second circular aperture 34 about the center housing axis 56 of the cylinder and plug assembly housing 20 allows the inner diameter 33 of the insert 32 to receive the cylinder and plug assembly housing 20 while the outer diameter 42 of the insert 32 is in registration with the first circular aperture 28 and while the cover plate 26 is in registration with the lock 12.

Figure 10:
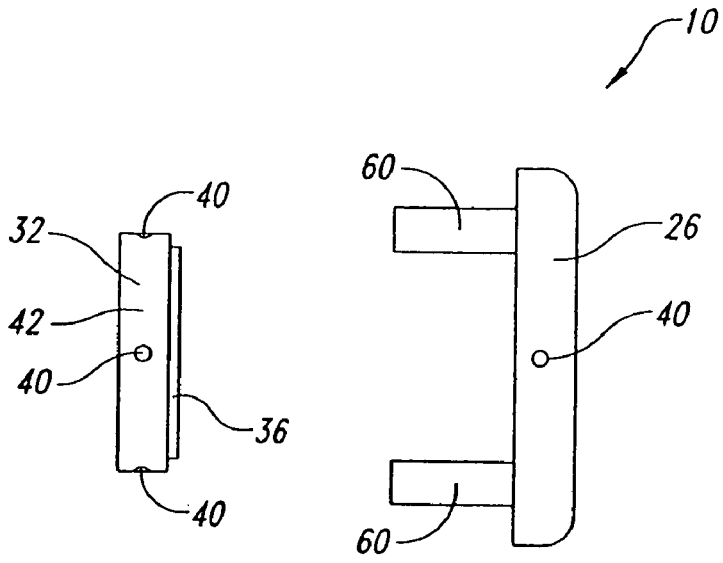
FIG. 10 is an isometric exploded side view of the cover plate assembly shown in FIG. 1.

FIG. 10 shows that the plurality of detents 40 can serve as markings to assist a user with visually aligning the insert 32 with respect to the cover plate 26. Once the insert 32 is inserted within the first circular aperture 28 and a desired orientation for a particular rotational relationship between the bolt housing 16 and the plug portion 50 of the cylinder and plug assembly housing 20 is established, the insert 32 can be selectively fixed to the cover plate 26. As will be understood by one of ordinary skill in the art, this can be done in a number of ways. In one embodiment, one of the detents 40 on the insert 32 is aligned with the hole 44 on the side of the cover plate 26, and a set screw or other means is used to engage the detent 40 through the hole 44. Importantly the above structure allows leg portions 60 of the cover plate 26 to remain aligned with bores 62 on the bolt housing 16 in any of the configurations shown n FIGS. 6-9.

Figure 11:
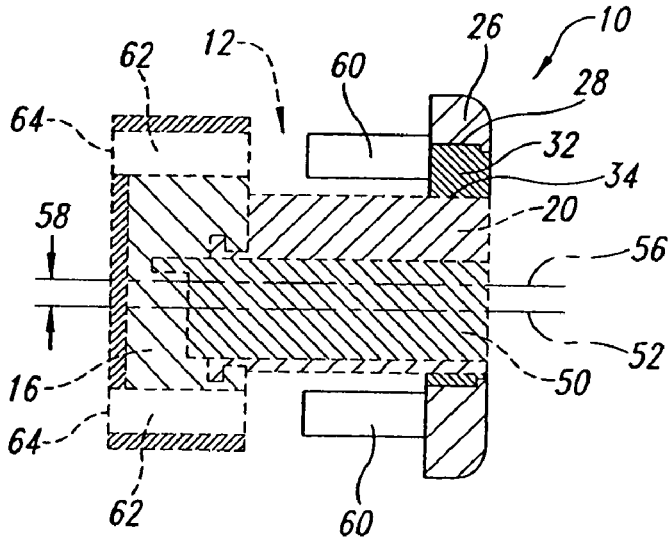
FIG. 11 is a partial side view of the lock and the cover plate assembly shown in the top drawer of FIG. 1 and taken along the lines 11-11.

To illustrate a final assembled position of the cover plate assembly 10, FIG. 11 shows a partial side view of the mounted lock 12 and assembled cover plate assembly 10 shown in the top drawer 14 of FIG. 1. When the first circular aperture 28 is centered about the center plug axis 52 and the second circular aperture 34 is centered about the center housing axis 56 of the cylinder and plug assembly housing 20, the insert 32 is in registration with the cylinder and plug assembly housing 20 and the cover plate 26 is in registration with the bolt housing 16. A leg portion 60 of the cover plate 26 is in spatial alignment with a bored portion 62 of the bolt housing 16 allowing screws or other fastening means to pass through a back side 64 of the bolt housing 16 through a cabinet door or drawer (not shown), and into the leg portion 60 of the cover plate 26 to simultaneously retain the bolt housing 16 and the cover plate assembly 10 to the cabinet door or drawer.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

The invention claimed is:

1. A combination cover plate assembly and cabinet door and drawer lock comprising:

a bolt housing having a reciprocating, retractable bolt and a cylinder and plug assembly housing, wherein a plug portion of the cylinder and plug assembly defines a first axis, the cylinder and plug assembly housing defines a second axis, and the bolt housing selectively rotates with respect to the plug portion of the cylinder and plug assembly about the first axis, a removable cover plate fixed to the bolt housing and defining a first circular aperture centered about the second axis which is displaced from the first axis when the cover plate is registered with the bolt housing; and a rotatable circular cover plate insert received within the first circular aperture defining a second circular aperture centered about the first axis, wherein the second circular aperture is sized to selectively receive the cylinder and plug assembly and an outer diameter of the insert is sized so that the insert fits within and is selectively rotatable with respect to the first circular aperture whereby the cylinder and plug assembly housing and the cover plate insert are rotatable with respect to the bolt housing and cover plate when the cover plate is fixed to the bolt housing.

2. The cover plate assembly of claim 1 wherein the first circular aperture has a peripheral stop and an outer circumference of the insert has a retaining ridge for cooperative engagement with the stop, and wherein the stop limits forward axial movement of the insert with respect to the cover plate.

3. The cover plate assembly of claim 2 wherein the cover plate and the insert have a substantially equal thickness and an outer surface of the cover plate is substantially flush with an outer surface of the insert when the circular cover plate insert is received within the first circular aperture.

4. The cover plate assembly of claim 1 wherein the cover plate has fixation means for rotatably and axially fixing the cover plate with respect to the bolt housing.

5. A combination cover plate assembly and cabinet door or drawer lock comprising:

a cabinet lock having a bolt housing having a reciprocating, retractable bolt, the bolt housing being selectively rotatable through 360° with respect to a plug portion of a cylinder and plug assembly;

a cover plate defining a first circular aperture; and a rotatably circular cover plate insert defining an eccentrically positioned second circular aperture wherein the second circular aperture defines an inner diameter sized to selectively receive the cylinder and plug assembly and wherein the insert has an outer diameter sized to fit within and selectively rotate with respect to the first circular aperture such that the cover plate may be fixedly connected to the bolt housing while permitting the cover plate insert and the cylinder and plug assembly to be rotated through 360°, whereby pin springs in the cylinder and plug assembly are advantageously maintained in a vertical orientation regardless of an orientation of the bolt housing.

* * * * *